US008193919B2

(12) United States Patent
Langer et al.

(10) Patent No.: US 8,193,919 B2
(45) **Date of Patent: *Jun. 5, 2012**

(54) APPARATUSES AND METHODS FOR DRIVING A DOORBELL SYSTEM PERIPHERAL LOAD AT A HIGHER CURRENT

(76) Inventors: Peter Langer, Macomb, MI (US); Douglas C. Cinzori, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/978,442

(22) Filed: Dec. 24, 2010

(65) Prior Publication Data

US 2011/0090068 A1 Apr. 21, 2011

Related U.S. Application Data

(60) Continuation-in-part of application No. 12/326,017, filed on Dec. 1, 2008, now abandoned, which is a division of application No. 11/744,834, filed on May 5, 2007, now Pat. No. 7,477,134.

(51) Int. Cl.
*G08B 27/00* (2006.01)

(52) U.S. Cl. ..... 340/326; 340/328; 340/384.1; 340/392.1; 340/567; 340/692

(58) Field of Classification Search ..... 340/326, 340/328, 330, 286.02, 286.11, 384.1, 384.6, 340/384.7, 392.1, 392.3, 538, 692, 567; 379/167.05, 379/167.01

See application file for complete search history.

(56) References Cited

U.S. PATENT DOCUMENTS 6,992,591 B2 * 1/2006 Jensen et al. ..... 340/815.5

* cited by examiner

*Primary Examiner* — Hung T. Nguyen
(74) *Attorney, Agent, or Firm* — Douglas C. Cinzori

(57) ABSTRACT

A peripheral load driver that utilizes the power, wiring, and primary load of a conventional doorbell system to drive a doorbell system peripheral load at a higher current without risk of inadvertently energizing the primary load of the conventional doorbell system. The peripheral load driver comprising a power converting means for converting power extracted from the conventional doorbell system from a higher-voltage-at-a-lower-current to a lower-voltage-at-a-higher current wherein the higher-voltage-at-a-lower-current is insufficient to energize the primary load of the conventional doorbell system and the lower-voltage-at-a-higher-current is compatible with the doorbell system peripheral load.

10 Claims, 9 Drawing Sheets

APPARATUSES AND METHODS FOR DRIVING A DOORBELL SYSTEM PERIPHERAL LOAD AT A HIGHER CURRENT

CROSS-REFERENCE TO RELATED APPLICATIONS

This is a continuation-in-part of U.S. patent application Ser. No. 12/326,017 (Langer et al.), filed Dec. 1, 2008 now abandoned, which is a division of U.S. patent application Ser. No. 11/744,834 (Langer et al.), filed May 5, 2007, now U.S. Pat. No. 7,477,134.

BACKGROUND OF THE INVENTION

This invention relates generally to doorbell systems and particularly to apparatuses and methods for driving a doorbell system peripheral load at a higher current wherein said apparatuses and methods utilize the power, wiring, and primary load of a conventional doorbell system.

Conventional doorbell systems in buildings, typically residences, throughout the United States and elsewhere are hardwired and comprise a transformer, a primary load, and a pushbutton. The transformer lowers standard household AC voltage to a level required to operate the primary load. The primary load is an electromagnetic or electronic sound device that operates on low voltage and is typically a bell, buzzer, or chime. The pushbutton is typically a normally open switch. System activation requires physical contact with the pushbutton. Manual depression of the pushbutton closes an electrical circuit causing the primary load to energize.

While most conventional pushbuttons are essentially non-power-consuming devices, some comprise an integrated illumination device. The illumination device serves to illuminate the pushbutton at dark and is typically an incandescent bulb or a light emitting diode. Conventional pushbuttons with an integrated illumination device are typically referred to as illuminated or lighted pushbuttons.

Considerations of convenience, security, and/or simply surprise and delight have led to the development of various alternate pushbuttons. Unlike conventional illuminated or lighted pushbuttons, the alternate pushbuttons have as a primary object, illuminating the space in the proximity of the pushbutton in addition to or instead of solely illuminating the pushbutton itself. The alternate pushbuttons comprise one or more integrated and/or external illumination devices and may or may not be drop-in replacements for conventional pushbuttons. U.S. Pat. No. 7,180,021 (Birdwell et al.) discloses a drop-in replacement "LED Illuminated Door Chime Pushbutton with Adjustable Task Light". U.S. Pat. Appl. Publ. No. 2004/0095254 (Maruszczak) discloses a non-drop-in replacement "Door Bell Answering System" that includes an exterior panel comprising a pushbutton and safety light.

Unfortunately, all of the alternate pushbuttons devised thus far, drop-in replacement or not, have one or more significant disadvantages that have prevented their widespread application.

The drop-in replacement alternate pushbuttons, including Birdwell's, have significant operating current limitations and consequently significant illumination intensity limitations. The operating current limitations are a consequence of system topology. Because they extract their power from a conventional doorbell system and are connected in series with a conventional doorbell system primary load, if they extract too much current they will cause the primary load to inadvertently energize (i.e., energize without the pushbutton being pressed). While the operating current capacities and illumination intensities of the alternate pushbuttons may be sufficient for adequately illuminating the pushbutton itself, they are insufficient for adequately illuminating the space in the proximity of the pushbutton.

The non-drop-in replacement alternate pushbuttons, including Maruszczak's, are independent or predominantly independent systems. That is, unlike the drop-in replacement pushbuttons, they do not extract their power solely from a conventional doorbell system and/or are not connected in series with a conventional doorbell system primary load and therefore they do not necessarily have significant operating current or illumination intensity limitations. However, because they do not, or do not adequately, interface with or compliment a conventional doorbell system, they are complex, difficult to install, expensive, redundant, and/or require periodic maintenance (e.g., battery replacement).

BRIEF SUMMARY OF THE INVENTION

In light of the foregoing, the primary object of the present invention is to utilize the power, wiring, and primary load of a conventional doorbell system so as to provide a simple, easy to install, inexpensive, and maintenance free means to drive a doorbell system peripheral load, such as an illumination device, at a higher current without risk of inadvertently energizing the primary load of the conventional doorbell system. Further objects will become apparent from a consideration of the ensuing description and drawings.

DETAILED DESCRIPTION OF THE INVENTION

Figure 1:
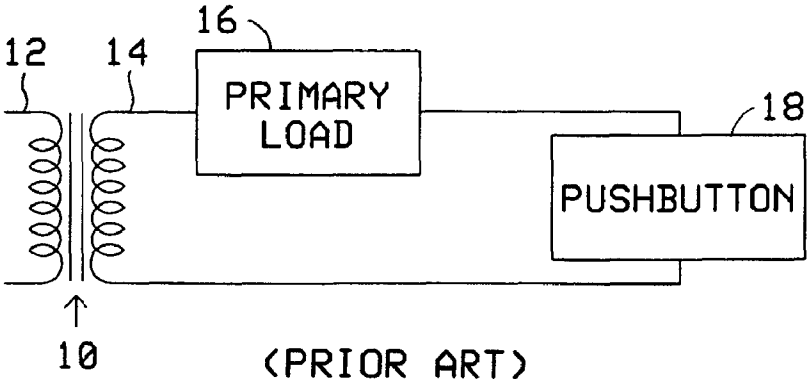
(PRIOR ART) FIG. 1
FIG. 1 is a schematic block diagram of a conventional doorbell system utilizing a pushbutton.

In the following description and operation sections, the same reference numerals are used to identify the same components in the various views. While the present invention is described and illustrated herein with reference to specific embodiments, various alternate embodiments that do not depart from the scope and spirit of the invention will be evident to one skilled in the art. For example, the visible light sensor described below can be replaced or supplemented by an audible sound sensor, a capacitive sensor, an infrared sensor, a microwave sensor, a radio frequency sensor, or an ultrasonic sensor. Similarly, the microprocessor circuit described below can be replaced or supplemented by a discrete logic circuit, an application specific integrated circuit, or a state machine circuit. Other examples will become apparent from a consideration of the ensuing description and drawings.

Description of First Embodiment

Figure 2:
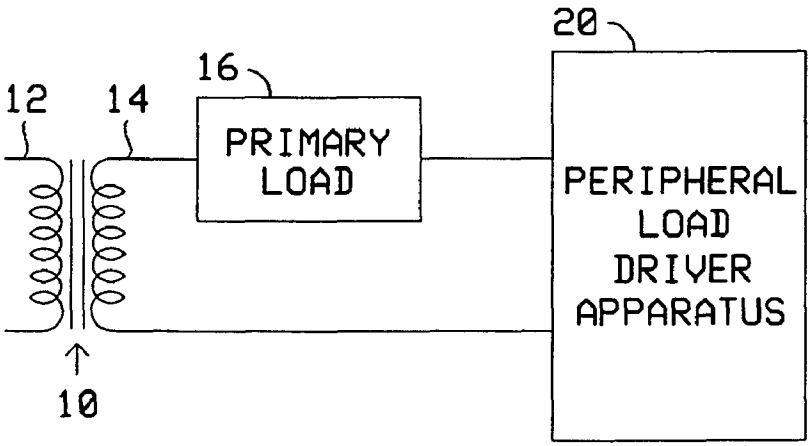
FIG. 2 is a schematic block diagram of a novel doorbell system utilizing a peripheral load driver according to the present invention.

Referring to FIG. 1, a schematic block diagram of a conventional doorbell system utilizing a pushbutton 18 is illustrated. Referring to FIG. 2, a schematic block diagram of a novel doorbell system utilizing a novel peripheral load driver 20 is illustrated. Comparison of these FIGS. shows that peripheral load driver 20 is a drop-in replacement device for pushbutton 18, coupling directly to the conventional doorbell system's pushbutton wires.

The doorbell system shown in FIG. 2 comprises a transformer 10, a primary load 16, and peripheral load driver 20. Transformer 10 comprises a primary winding 12 and a secondary winding 14. Primary winding 12 of transformer 10 is connected to a standard household AC voltage supply. Secondary winding 14 of transformer 10 is connected in series to primary load and peripheral load driver 20. Transformer 10 lowers the standard household AC voltage to a level that is compatible with primary load 16. Primary load 16 is an electromagnetic or electronic sound device that operates on low voltage and is typically a bell, buzzer, or chime.

The power necessary to operate peripheral load driver 20 is extracted from the conventional doorbell system. Peripheral load driver 20 is configured so that the current extracted from the conventional doorbell system is an amount sufficiently high so as to permit operation of peripheral load driver 20 but sufficiently low so as to prevent inadvertent energization of primary load 16.

Figure 3:
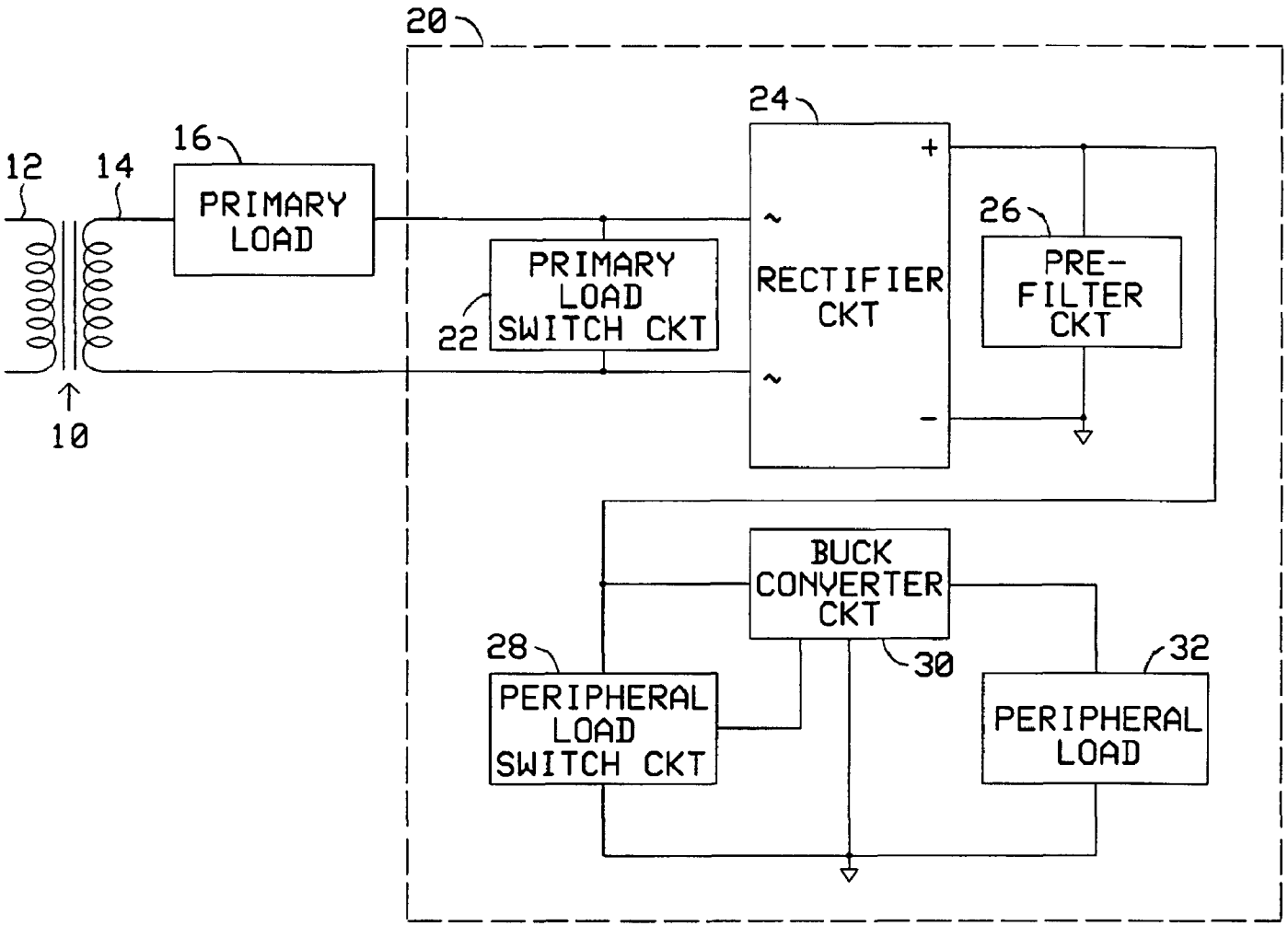
FIG. 3 is a schematic block diagram of the doorbell system shown in FIG. 2 including the major components of the peripheral load driver.
Figure 4:
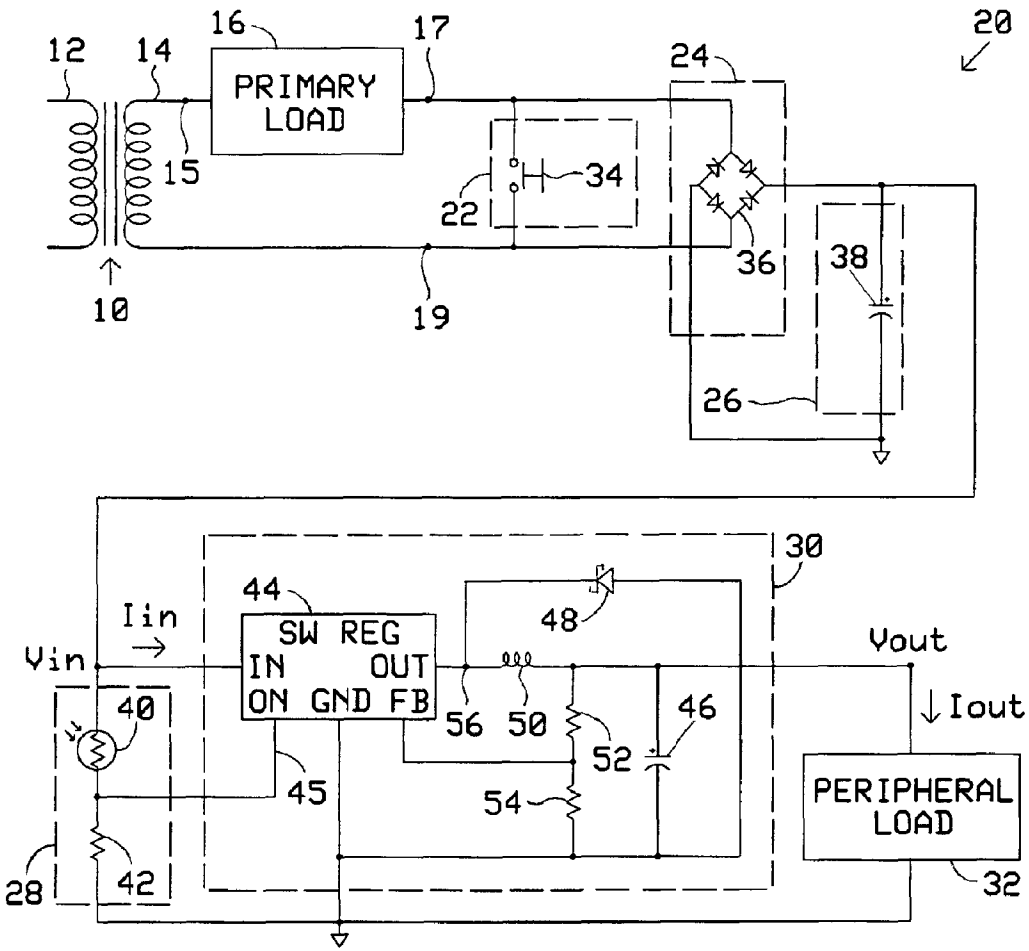
FIG. 4 is an electrical schematic of the doorbell system shown in FIG. 3.

Referring now to FIGS. 3 and 4, a schematic block diagram and an electrical schematic disclosing the major components of peripheral load driver 20 are respectively illustrated. As shown in these FIGS., peripheral load driver 20 comprises a primary load switch circuit 22, a rectifier circuit 24, a pre-filter circuit 26, a peripheral load switch circuit 28, a buck converter circuit 30, and a peripheral load 32.

Primary load switch circuit 22 comprising pushbutton 34 provides a means to manually control the operation of primary load 16. Rectifier circuit 24 comprising full-wave bridge rectifier 36 converts the stepped down household AC voltage at its input into pulsating DC voltage. Pre-filter circuit 26 comprising capacitor 38 reduces ripple in the pulsating DC voltage. Peripheral load switch circuit 28 comprising photocell 40 and resistor 42 senses ambient visible light and in conjunction with buck converter circuit 30 provides a means to automatically control the operation of peripheral load 32. Buck converter circuit 30 comprising switching regulator 44, capacitor 46, Schottky diode 48, inductor 50, and resistors 52, 54 efficiently converts the DC power at its input from a higher voltage (Vin) at a lower current (Iin) into a lower voltage (Vout) at a higher current (Iout) that is compatible with peripheral load 32. Switching regulator 44 is conventional in the art and may comprise a LM2574 step-down switching regulator manufactured by ON Semiconductor Corporation, 5005 East McDowell Road, Phoenix, Ariz. 85008. Peripheral load 32 is a power-consuming device that has a lower minimum operating voltage but higher minimum operating current than the minimum operating voltage and current of primary load 16. Peripheral load 32 may comprise an illumination device, a color-controllable illumination device, a receiving device, a recording device, a sound device, and/or a transmitting device. Peripheral load 32 may comprise a super high flux visible light emitting diode such as a Luxeon I Emitter manufactured by Lumileds Lighting, LLC, 370 West Trimble Road, San Jose, Calif. 95131.

Operation of First Embodiment

Operation of peripheral load driver 20 comprises two phases; a deactivation phase and an activation phase. During either phase, pressing pushbutton 34 closes an electrical circuit thereby coupling the stepped down household AC voltage to primary load 16 causing primary load 16 to energize.

During the deactivation phase, photocell 40 continuously senses ambient visible light intensity and in conjunction with resistor 42 operates as a voltage divider whose output is connected to an on/off pin 45 of switching regulator 44. Photocell 40's resistance and consequently the voltage at on/off pin 45 is inversely related to the light intensity that strikes photocell 40. When the voltage at on/off pin 45 falls below a threshold level (e.g., during nighttime) switching regulator 44 turns on and operation enters the activation phase.

During the activation phase, switching regulator 44 operates as a switch that efficiently and repetitively connects and disconnects DC input voltage Vin to and from node 56 at a requisite duty cycle resulting in a pulsating DC voltage at node 56 that has a lower average value than input voltage Vin. Inductor 50 in conjunction with capacitor 46, diode 48, and resistors 52, 54 conditions the pulsating DC voltage at node 56. Inductor 50 and capacitor 46 operate as a low pass filter that removes current and voltage ripple. Diode 48 operates as a freewheeling diode that provides a return path for current to flow into inductor 50 when input voltage Vin is disconnected from node 56. Resistors 52 and 54 operate as programming resistors that are used in conjunction with switching regulator 44 to set output voltage Vout to a requisite level.

The resulting output voltage Vout is a fixed DC voltage that is lower than input voltage Vin. One skilled in the art will recognize that the voltage conversion of input voltage Vin to a lower output voltage Vout results in a corresponding current conversion of input current Iin to a higher output current Iout. This is a consequence of the high efficiency E of buck converter circuit 30 and the principal of conservation of energy which requires that $Vout \times Iout = Vin \times In \times E$. The lower output voltage Vout and higher output current Iout are compatible with the power requirements of peripheral load 32. When switching regulator 44 is on, output voltage Vout is set above a threshold level, thereby causing peripheral load 32 to activate.

As during the deactivation phase, during the activation phase, photocell 40 continuously senses ambient visible light intensity. When the voltage at on/off pin 45 rises above a threshold level (e.g., during daytime) switching regulator 44 turns off thereby causing peripheral load 32 to deactivate and operation returns to the deactivation phase.

Note that optionally, primary load switch circuit 22 and/or peripheral load 32 can be located external to peripheral load driver 20. Note also that optionally, primary load switch circuit 22 can be replaced by an alternate embodiment comprising an automatic doorbell driver as disclosed in U.S. patent application Ser. No. 11/559,373 (Langer et al.).

Description of Second Embodiment

Figure 5:
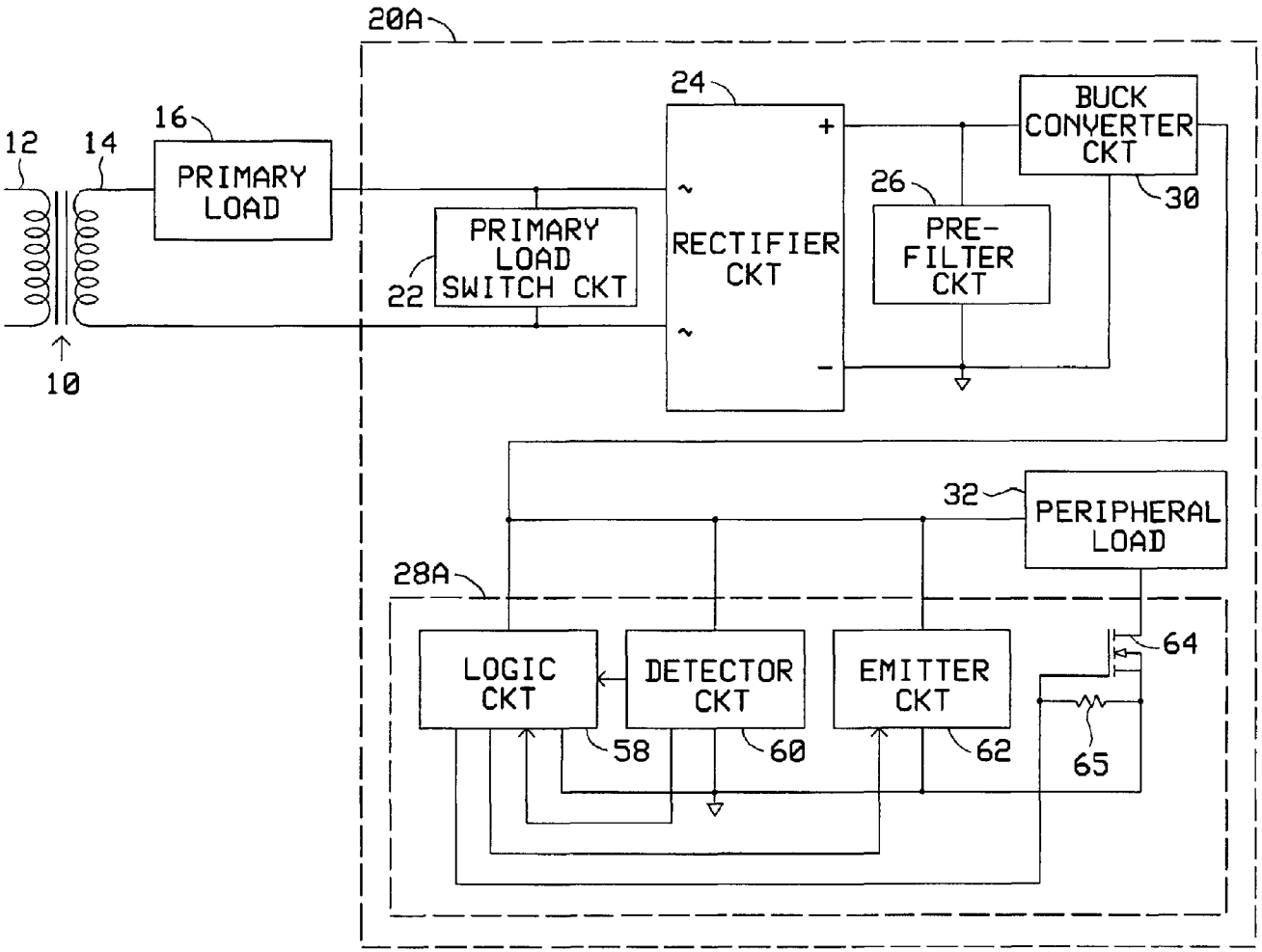
FIG. 5 is a schematic block diagram of a novel doorbell system utilizing an alternate embodiment of a peripheral load driver according to the present invention.
Figure 6:
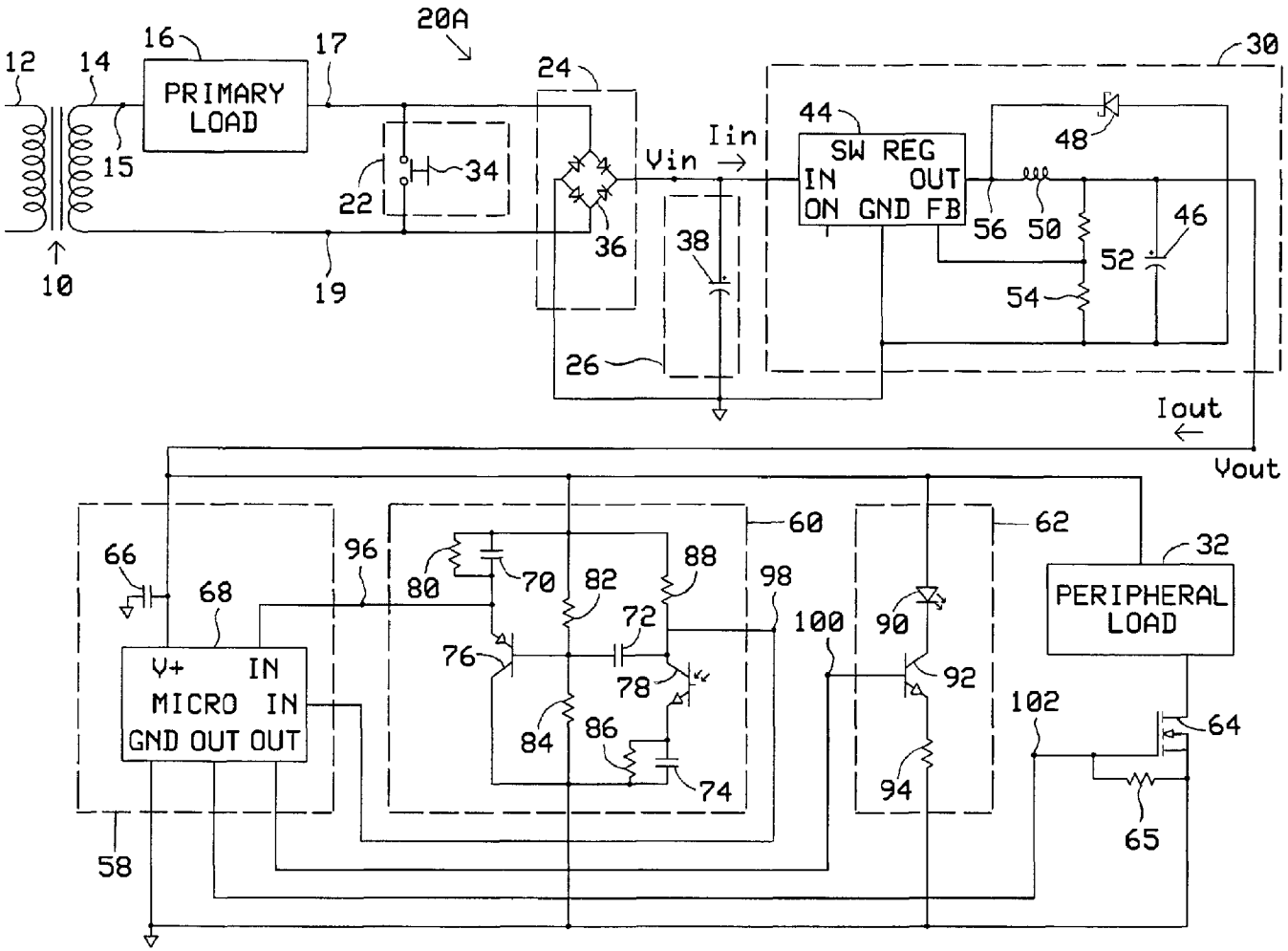
FIG. 6 is an electrical schematic of the doorbell system shown in FIG. 5.

Referring now to FIGS. 5 and 6, a schematic block diagram and an electrical schematic of a novel doorbell system utilizing an alternate embodiment of a peripheral load driver 20A are respectively illustrated. Peripheral load driver 20A differs from peripheral load driver 20 shown in FIGS. 3 and 4 in that it includes peripheral load switch circuit 28A in place of peripheral load switch circuit 28. Unlike peripheral load switch circuit 28, peripheral load switch circuit 28A is located on the output rather than the input side of buck converter circuit 30 and is powered by buck converter circuit 30. Further, peripheral load switch circuit 28A utilizes motion sensing in addition to ambient visible light sensing to automatically control the operation of peripheral load 32.

Peripheral load switch circuit 28A comprises a logic circuit 58, a detector circuit 60, an emitter circuit 62, N-channel enhancement mode MOSFET 64, and resistor 65. Logic circuit 58 comprising capacitor 66 and microprocessor 68 performs logic operations according to microprocessor 68's programming. Microprocessor 68 is conventional in the art and may comprise a MC68HC908QT4 microcontroller manufactured by Freescale Semiconductor, Inc., 6501 William Cannon Drive West, Austin, Tex. 78735. Detector circuit 60 comprising capacitors 70, 72, 74, PNP bipolar transistor 76, NPN phototransistor 78, and resistors 80, 82, 84, 86, 88 senses ambient and reflected visible light. Emitter circuit 62 comprising visible light emitting diode 90, NPN bipolar transistor 92, and resistor 94 emits pulsed visible light. MOSFET 64 in conjunction with resistor 65 operates as a switch that is controlled by logic circuit 58.

Operation of Second Embodiment

Unlike the previous embodiment, operation of this embodiment comprises three rather than two phases; a deactivation phase, a standby phase, and an activation phase. During all three phases, operation of pushbutton 34 is identical to that of the previous embodiment. Operation of buck converter circuit 30 is identical to that of the previous embodiment with the exception that switching regulator 44 is always on rather than solely on during the activation phase.

During the deactivation phase, phototransistor 78 continuously senses ambient visible light intensity. The voltage at the collector of phototransistor 78 is inversely related to the light intensity that strikes phototransistor 78. When microprocessor 68 senses a voltage above a threshold level at node 98 (e.g., during nighttime), operation enters the standby phase.

During the standby phase, microprocessor 68 provides a pulsed voltage above a threshold level at node 100 thereby intermittently turning on transistor 92 and diode 90 causing diode 90 to emit pulsed light toward a proximity zone outside a building's doorway. When an object, such as a person, enters the proximity zone, the pulsed light is reflected off the object and is thereupon sensed by phototransistor 78 which in conjunction with capacitor 74 and resistors 86, 88 operates as an inverting amplifier configured to provide unity DC gain and high AC gain. This configuration ensures that the amplifier is most responsive to pulsed light emitted from diode 90 and least responsive to steady state light emitted from other sources such as incandescent light or daylight. The sensed reflected pulsed light off the approaching object results in an inverted pulsed voltage at the collector of phototransistor 78 which passes through coupling capacitor 72 to the base of transistor 76. Transistor 76 in conjunction with capacitor 70 and resistors 80, 82, 84 operates as an emitter-follower configured as a peak detector to capture the pulsed voltage at the collector of phototransistor 78. Resistors 82 and 84 provide a positive DC voltage bias at the base of transistor 76 resulting in a corresponding DC voltage bias at node 96 that is one diode drop greater than the voltage at the base of transistor 76. The inverted pulsed voltage at the base of transistor 76 results in a corresponding inverted pulsed voltage at node 96 which is superimposed on the positive DC voltage bias. When microprocessor 68 senses voltage pulses below a threshold level and above a threshold frequency of occurrence at node 96, it turns off transistor 92 and diode 90 and operation enters the activation phase.

During the activation phase, microprocessor 68 provides a voltage above a threshold level at node 102 thereby turning on MOSFET 64 causing peripheral load 32 to activate. When peripheral load 32 has been activated for a requisite period of time, microprocessor 68 turns off MOSFET 64 causing peripheral load 32 to deactivate and operation returns to the standby phase.

As during the deactivation phase, during both the standby and activation phases, phototransistor 78 continuously senses ambient visible light intensity. During the standby phase, when microprocessor 68 senses a voltage below a threshold level at node 98 (e.g., during daytime), it turns off transistor 92 and diode 90 and operation returns to the deactivation phase. During the activation phase, when microprocessor 68 senses a voltage below a threshold level at node 98, it turns off MOSFET 64 causing peripheral load 32 to deactivate and operation returns to the deactivation phase.

Note that if peripheral load 32 comprises a super high flux visible light emitting diode, then emitter circuit 62 can be removed. In this case, peripheral load 32 and MOSFET 64 can serve as both an emitter circuit and a peripheral load circuit.

Note also that optionally, primary load switch circuit 22, can be replaced by a microprocessor-controlled primary load switch circuit (not shown) comprising a pushbutton and a MOSFET. Unlike primary load switch circuit 22, the microprocessor-controlled primary load switch circuit is located on the DC rather than the AC side of rectifier circuit 24. One side of the pushbutton is connected to microprocessor 68 and the other side is connected to ground. The gate of the MOSFET is connected to microprocessor 68, the drain is connected to Vin, and the source is connected to ground. When microprocessor 68 detects a pushbutton press it turns on the MOSFET causing primary load 16 to energize. Utilization of a microprocessor-controlled primary load switch circuit may be desirable because it provides greater design flexibility. For example, it can prevent nuisance activations of primary load 16 by ignoring rapid successive presses of the pushbutton. Further, it can limit and/or prevent power interruptions to peripheral load driver 20A by limiting the duration that primary load 16 is energized when the pushbutton is pressed. Still further, it can control and/or program microprocessor 68 by recognizing a "push and hold" pushbutton press as a control and/or programming command.

Description of Third Embodiment

Figure 7:
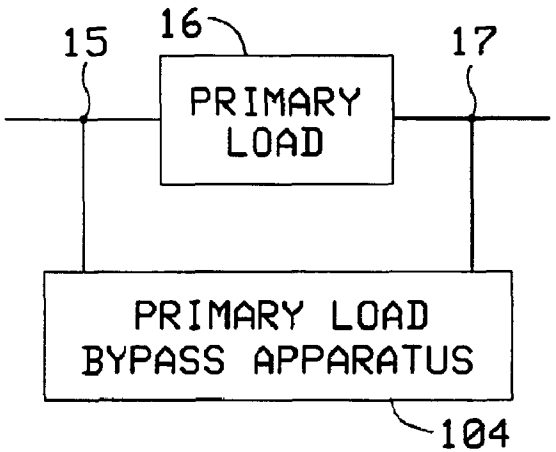
FIG. 7 is a partial schematic block diagram of a novel doorbell system utilizing a primary load bypass apparatus according to the present invention.

The previous embodiments utilize a buck converter circuit to drive a doorbell system peripheral load at a higher current. Referring now to FIG. 7, for peripheral loads that require still higher current, a primary load bypass apparatus 104 is added in parallel with primary load 16 between nodes 15 and 17. The added primary load bypass apparatus 104 diverts a preponderance of the current away from primary load 16 when pushbutton 34 is not pressed thereby permitting peripheral load driver 20 or 20A to extract the requisite higher current without risk of inadvertently energizing primary load 16.

Figure 8:
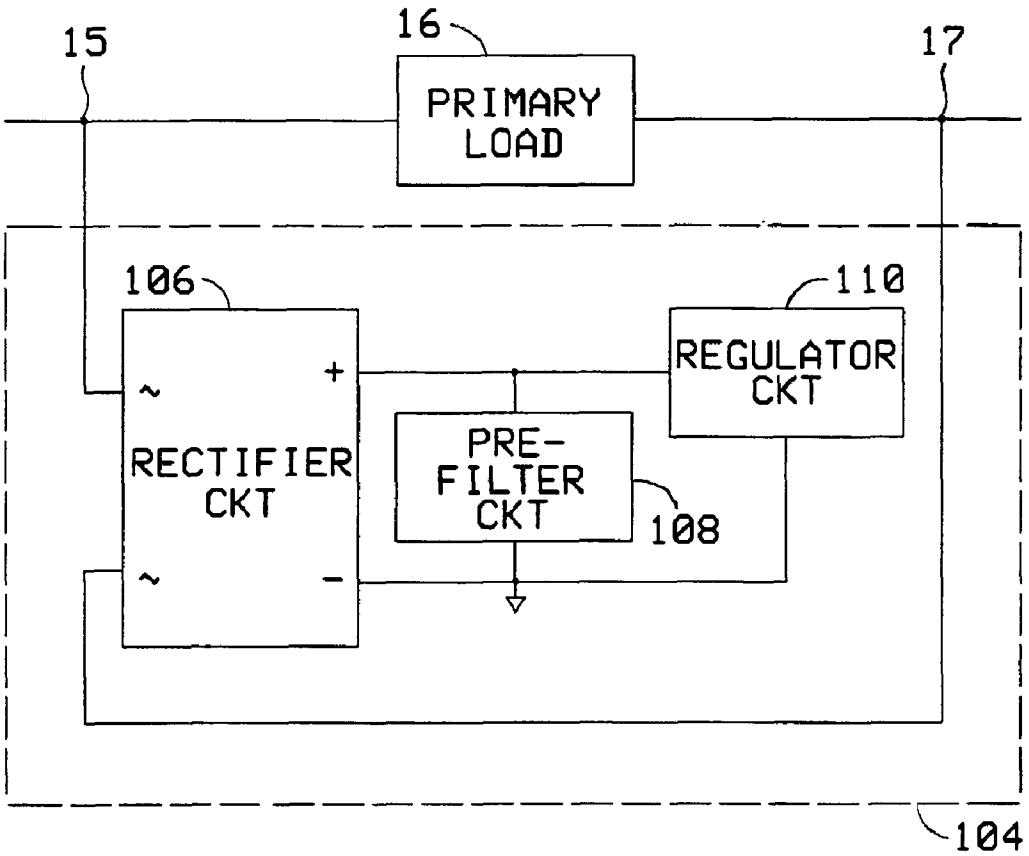
FIG. 8 is schematic block diagram of the partial doorbell system shown in FIG. 7 including the major components of the primary load bypass apparatus.
Figure 9:
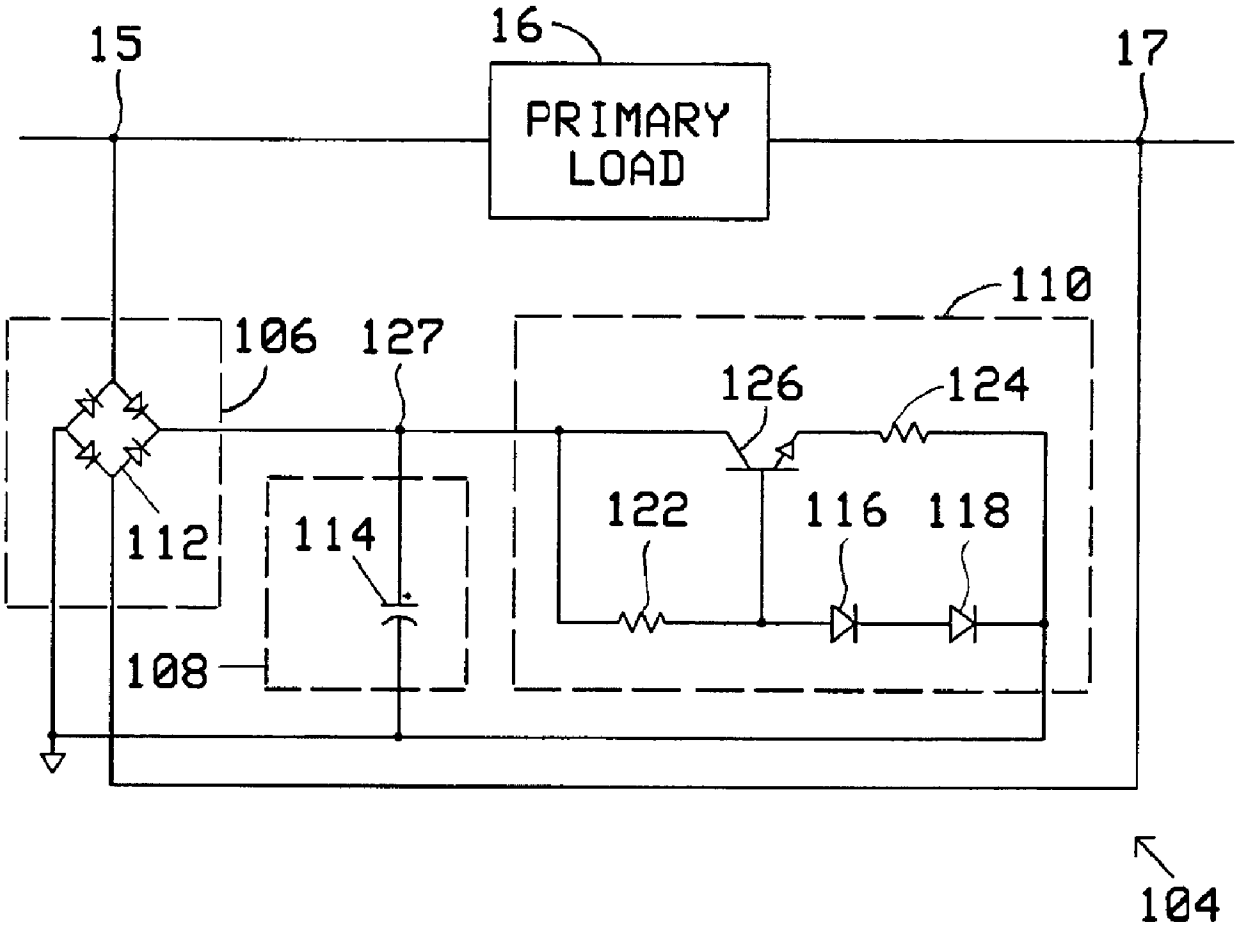
FIG. 9 is an electrical schematic of the partial doorbell system shown in FIG. 8.

Referring now to FIGS. 8 and 9, a schematic block diagram and an electrical schematic disclosing the major components of primary load bypass apparatus 104 are respectively illustrated. As shown in these FIGS., primary load bypass apparatus 104 comprises a rectifier circuit 106, a pre-filter circuit 108, and a regulator circuit 110.

Rectifier circuit 106 comprising full-wave bridge rectifier 112 converts the stepped down household AC voltage at its input into pulsating DC voltage. Pre-filter circuit 108 comprising capacitor 114 reduces ripple in the pulsating DC voltage. Regulator circuit 110 comprising diodes 116, 118, resistors 122, 124, and transistor 126 operate as a current regulator that outputs a DC current up to a current limit value.

Operation of Third Embodiment

When pushbutton 34 is not pressed, bridge rectifier 112 provides a voltage above a threshold at node 127 causing current to flow through resistor 122 and diodes 116, 118 resulting in a corresponding voltage above a threshold level at the base of transistor 126 thereby turning on transistor 126. Transistor 126 operates in the saturation region and provides a DC output current that is lower than the current limit value of regulator circuit 110. The DC output current is equal to (the voltage drop across diode 116 plus the voltage drop across diode 118 minus the voltage drop across the base emitter junction of transistor 126) divided by the value of resistor 124. The DC output current from regulator circuit 110 results in a corresponding AC output current from primary load bypass apparatus 104. The voltage drop across primary load bypass apparatus 104 and consequently the voltage drop across primary load 16 is low and comprises the sum of the voltage drops across rectifier circuit 106 and regulator circuit 110. Because the impedance of primary load bypass apparatus 104 is lower than the impedance of primary load 16, a preponderance of the current extracted by peripheral load apparatus 20 or 20A passes through primary load bypass apparatus 104 rather than primary load 16. The current passing through primary load 16 is sufficiently low so as not to cause primary load 16 to inadvertently energize.

When pushbutton 34 is pressed, the impedance of peripheral load driver 20 or 20A is shunted from the doorbell system circuit creating an increased current demand that is higher than the current limit value of regulator circuit 110. Increased current passes through regulator circuit 110 up to its current limit value. Further increased current through regulator circuit 110 is impeded as transistor 126 operates in a current limiting mode thereby forcing the further increased current to pass through primary load 16 causing primary load 16 to be energized.

Note that optionally, regulator circuit 110 can be replaced by an alternate embodiment comprising a linear or switching regulator integrated circuit such as a LM317 3-Terminal Adjustable Regulator manufactured by National Semiconductor, 2900 Semiconductor Dr., Santa Clara, Calif. 95052.

Description of Fourth Embodiment

Figure 10:
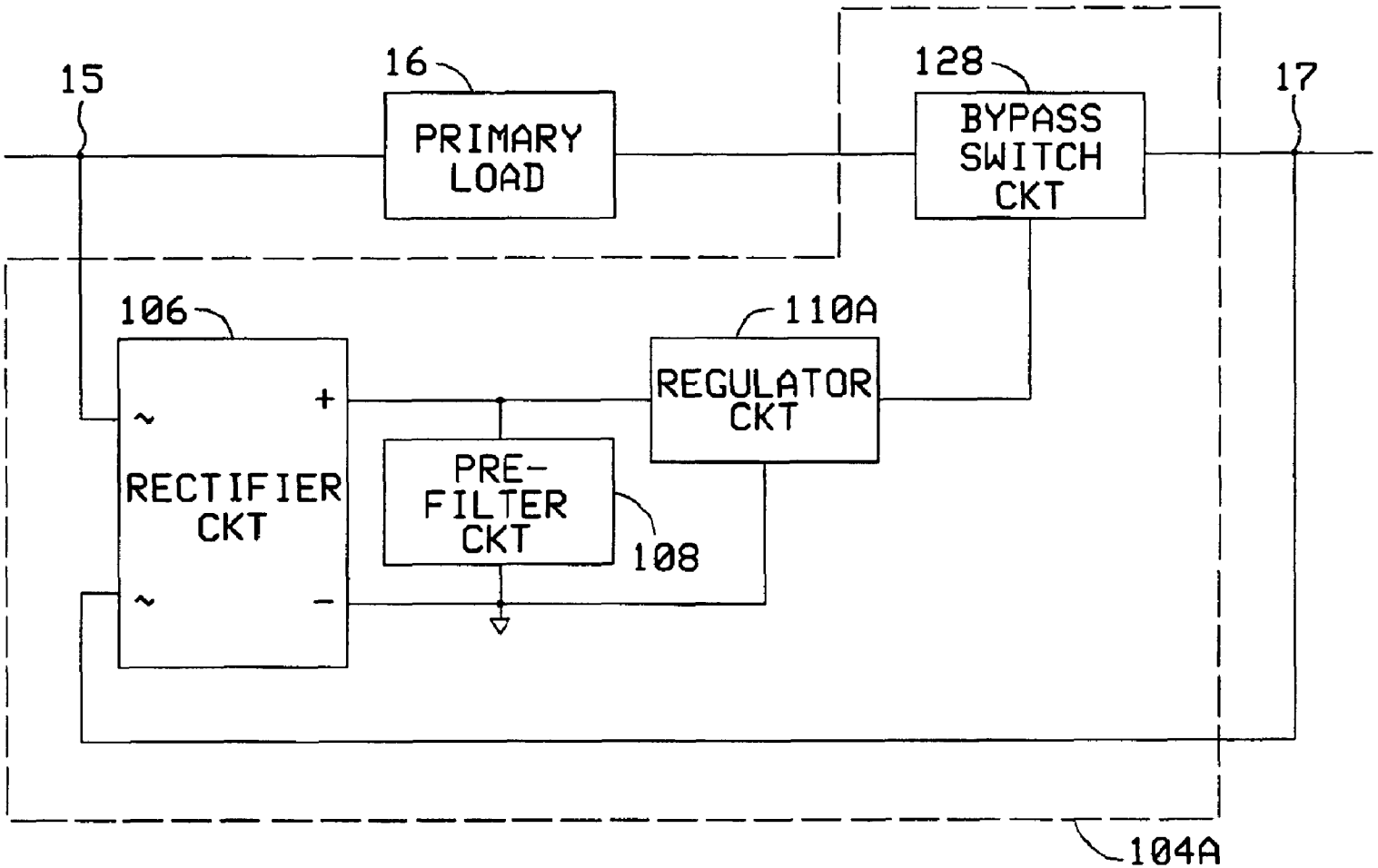
FIG. 10 is a partial schematic block diagram of a novel doorbell system utilizing an alternate embodiment of a primary load bypass apparatus according to the present invention.
Figure 11:
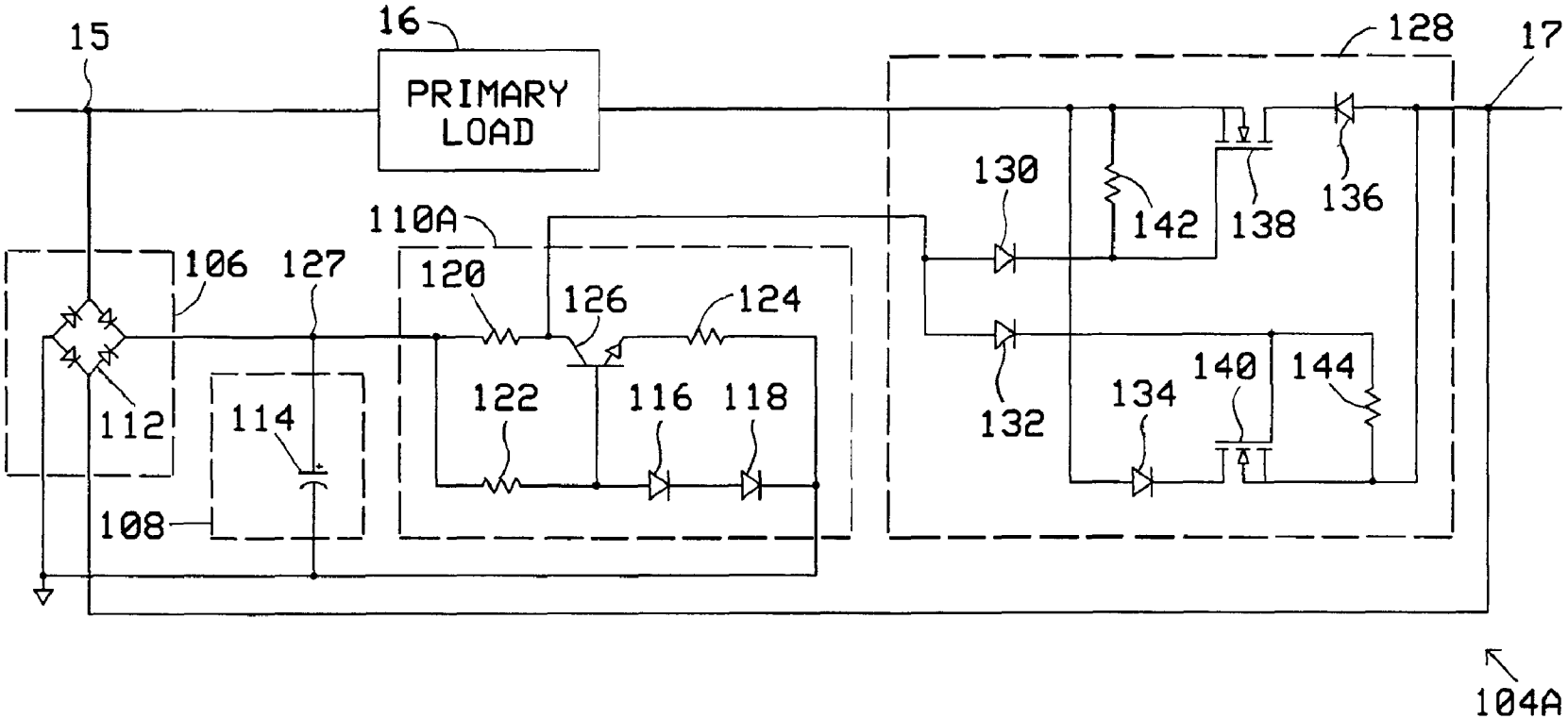
FIG. 11 is an electrical schematic of the partial doorbell system shown in FIG. 10.

Referring now to FIGS. 10 and 11, a schematic block diagram and an electrical schematic disclosing the major components of an alternate embodiment of a primary load bypass apparatus 104A are respectively illustrated. Primary load bypass apparatus 104A differs from primary load bypass apparatus 104 shown in FIGS. 8 and 9 in that it includes regulator circuit 110A in place of regulator circuit 110 and further includes bypass switch circuit 128. Unlike primary load bypass apparatus 104, primary load bypass apparatus 104A diverts all, rather than only a preponderance, of the current away from primary load 16 when pushbutton 34 is not pressed thereby permitting peripheral load driver 20 or 20A to extract still higher current than the previous embodiment without risk of inadvertently energizing primary load 16.

Regulator circuit 110A differs from regulator circuit 110 in that it includes resistor 120. Added resistor 120 permits regulator circuit 110A to provide a voltage at the collector of transistor 126 corresponding to the sensed state of pushbutton 34. Bypass switch circuit 128 comprising diodes 130, 132, 134, 136, N-channel enhancement mode metal oxide semiconductor field effect transistors (MOSFETS) 138, 140, and resistors 142, 144 operate as a switch that responds to the voltage at the collector of transistor 126.

Operation of Fourth Embodiment

When pushbutton 34 is not pressed, the voltage at the collector of transistor 126 is below a threshold level resulting in a corresponding voltage below a threshold level at the gates of MOSFETS 138 and 140 thereby keeping off MOSFETS 138 and 140. When MOSFETS 138 and 140 are off, the series current paths between primary load 16 and peripheral load driver 20 or 20A are open causing primary load 16 to be deenergized. All of the current extracted by peripheral load driver 20 or 20A bypasses rather than passes through primary load 16 thereby preventing primary load 16 from inadvertently energizing.

When pushbutton 34 is pressed, the impedance of peripheral load driver 20 or 20A is shunted from the doorbell system circuit creating an increased current demand that is higher than the current limit value of regulator circuit 110A. Increased current passes through regulator circuit 110A including resistors 120 and 124 up to its current limit value. Further increased current through regulator circuit 110A is impeded as transistor 126 operates in a current limiting mode. Due to the voltage divider formed by resistors 120, 124, and transistor 126, the increased current through resistors 120 and 124 results in a corresponding increased voltage at the collector of transistor 126. The voltage at the collector of transistor 126 is above a threshold level resulting in a corresponding voltage above a threshold level at the gates of MOSFETS 138 and 140 that is of sufficient magnitude to turn on MOSFETS 138 and 140. When MOSFETS 138 or 140 are on, a series current path between primary load 16 and peripheral load driver 20 or 20A is closed causing primary load 16 to be energized. Diodes 130, 132, 134, and 136 ensure that MOSFETS 138 and 140 do not conduct current at the same time. Diode 134 and MOSFET 140 conduct current when the AC output voltage from transformer 10 is positive whereas diode 136 and MOSFET 138 conduct current when the AC output voltage from transformer 10 is negative. Resistors 142 and 144 respectively maintain a zero gate to source voltage across MOSFETS 138 and 140 to ensure that MOSFETS 138 and 140 do not inadvertently turn on.

Note that optionally, primary load bypass apparatus 104A can be replaced by an alternate embodiment comprising a relay (not shown) wherein the relay comprises a coil and normally open contacts. The coil is connected in parallel with primary load 16 between nodes 15 and 17. The normally open contacts are connected in series with primary load 16 between primary load 16 and node 17. The relay pick-up voltage is such that when pushbutton 34 is not pressed, the normally open contacts are open and all of the current extracted by peripheral load driver 20 or 20A bypasses rather than passes through primary load 16 thereby preventing primary load 16 from inadvertently energizing. When pushbutton 34 is pressed, the normally open contacts are closed and current passes through primary load 16 causing primary load 16 to energize.

Note also that primary load bypass apparatus 104 or 104A can independently drive a doorbell system peripheral load at a higher current without inadvertently energizing primary load 16. In this case, the peripheral load does not necessarily have a lower minimum operating voltage than the minimum operating voltage of primary load 16.

Note further that while primary load bypass apparatus 104 or 104A can independently drive a doorbell system peripheral load at a higher current without inadvertently energizing primary load 16, by combining primary load bypass apparatus 104 or 104A with peripheral load driver 20 or 20A, a synergistic result is achieved. That is, the combination can drive a doorbell system peripheral load at a higher current without inadvertently energizing primary load 16 than each subcombination can independently.

Description of Fifth Embodiment

The previous embodiments are compatible with doorbell systems utilizing a conventional electromagnetic primary load. Referring again to FIGS. 4 and 6, to be compatible with doorbell systems utilizing a conventional electronic primary load a diode (not shown) is added with its cathode connected to node 17 and its anode connected to node 19 (or vice versa depending upon the requirements of the particular electronic primary load). The added diode operates as a half-wave rectifier resulting in a pulsating DC voltage that serves to provide primary load 16 with a constant source of power.

Operation of Fifth Embodiment

Operation of this embodiment is identical to that of the previous embodiments with the exception that primary load 16 utilizes the stepped down household AC voltage coupled to it when pushbutton 34 is pressed as a trigger rather than to directly produce a sound. When primary load 16 detects the trigger, it energizes an internal sound device. The sound device can remain energized indefinitely, even after pushbutton 34 is released, due to the constant source of power provided by the added diode.

Note that while the previous embodiments contemplate a peripheral load coupled to a primary load switch circuit and/or a primary load bypass apparatus coupled to a primary load, one skilled in the art will recognize that neither a primary load switch circuit nor a primary load are necessary to achieve the object of driving a peripheral load at a higher current. Various alternate embodiments will be evident to one skilled in the art that contemplate a peripheral load coupled in place of a primary load switch circuit and/or a primary load bypass apparatus coupled in place of a primary load. For example, in the third embodiment, primary load 16 can be removed. In this case, doorbell functionality can be accomplished by adding a radio frequency transmitter (not shown) from the collector of transistor 126 to the emitter of transistor 126. The added radio frequency transmitter permits peripheral load driver apparatus 104 to communicate with a remote radio frequency receiver comprising a sound device. Also for example, in the third embodiment primary load 16 can be removed and primary load bypass apparatus 104 can be replaced by a low impedance conductor or a fuse, including a positive temperature coefficient (PTC) resettable fuse. The low impedance conductor or fuse serves to divert power extracted from the doorbell system directly to peripheral load driver apparatus 20 or 20A, thereby providing peripheral load 32 with a constant higher current power source. In this case, doorbell functionality can be accomplished by adding a radio frequency transmitter to peripheral load driver apparatus 20 or 20A.

We claim:

1. A primary load bypass apparatus that when coupled to or in place of the primary load of a conventional doorbell system comprising a transformer, a primary load, and a primary load switching means for switching power to and from said primary load, can drive a doorbell system peripheral load at a higher current, said primary load bypass apparatus comprising:

a. power diverting means for diverting power extracted from said conventional doorbell system from said transformer toward said peripheral load through an alternate electrical circuit which bypasses said primary load.

2. The primary load bypass apparatus of claim 1, wherein said power diverting means comprises a current regulated circuit wherein said current regulated circuit passes current through it up to a threshold level and impedes current through it above said threshold level.

3. The primary load bypass apparatus of claim 1, wherein said power diverting means comprises switching means for switching power away from said primary load toward said peripheral load when said primary load switching means has not switched power to said primary load.

4. The primary load bypass apparatus of claim 3, wherein said switching means comprises a relay.

5. The primary load bypass apparatus of claim 1, wherein said power diverting means comprises a low impedance conductor.

6. The primary load bypass apparatus of claim 1, wherein said power diverting means comprises a fuse.

7. The primary load bypass apparatus of claim 6, wherein said fuse is resettable.

8. The primary load bypass apparatus of claim 7, wherein said fuse is a positive temperature coefficient (PTC) resettable fuse.

9. The primary load bypass apparatus of claim 1, further comprising a radio frequency transmitter for communicating with a remote radio frequency receiver.

10. A method for driving a doorbell system peripheral load at a higher current wherein said method utilizes a conventional doorbell system comprising a transformer, a primary load, and a primary load switching means for switching power to and from said primary load, said method comprising:

a. diverting power extracted from said conventional doorbell system from said transformer toward said peripheral load through an alternate electrical circuit which bypasses said primary load;

b. coupling the power diverted through said alternate electrical circuit to said peripheral load.

* * * * *